US006859195B2

(12) United States Patent
Kodate

(10) Patent No.: US 6,859,195 B2
(45) Date of Patent: Feb. 22, 2005

(54) DISPLAY DEVICE DRIVEN WITH DUAL TRANSISTORS

(75) Inventor: Manabu Kodate, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 313 days.

(21) Appl. No.: 09/683,226

(22) Filed: Dec. 4, 2001

(65) Prior Publication Data

US 2002/0054003 A1 May 9, 2002

(30) Foreign Application Priority Data

Dec. 14, 2000 (JP) ..... 2000-380010

(51) Int. Cl.[7] ..... G09G 3/36
(52) U.S. Cl. ..... 345/92; 349/48
(58) Field of Search ..... 345/92, 93; 349/46, 349/42, 48

(56) References Cited

U.S. PATENT DOCUMENTS 5,349,366 A * 9/1994 Yamazaki et al. ..... 345/92
5,805,248 A * 9/1998 Sakamoto et al. ..... 349/48
5,990,629 A * 11/1999 Yamada et al. ..... 315/169.3

FOREIGN PATENT DOCUMENTS

| | | | |
|---|---|---|---|
| JP | 05-188395 | 7/1993 | ..... G02F/1/136 |
| JP | 05-265045 | 10/1993 | ..... G02F/1/136 |
| JP | 05-303114 | 11/1993 | ..... G02F/1/136 |
| JP | 05-341734 | 12/1993 | ..... G09G/3/36 |
| JP | 06-138851 | 5/1994 | ..... G09G/3/36 |
| JP | 06-148680 | 5/1994 | ..... G02F/1/136 |
| JP | 09-329807 | 12/1997 | ..... G02F/1/136 |
| JP | 11-002837 | 1/1999 | ..... G02F/1/136 |

* cited by examiner

*Primary Examiner*—Joseph Mancuso
*Assistant Examiner*—Laurel E LeFlore
(74) *Attorney, Agent, or Firm*—Derek S. Jennings; Anne V. Dougherty

(57) ABSTRACT

A display device including a display area having a plurality of pixels arranged in a matrix includes a plurality of scan lines for selecting pixel rows, a multiplex signal line for transmitting a display signal to at least two pixels in one pixel row selected by each of the scan lines, and a select line provided independently of the plurality of scan lines. The scan lines, the multiplex signal line and the select line are disposed in the display area. The select line selects at least one of a plurality of pixels in the pixel row to which the multiplex signal line transmits the display signal.

14 Claims, 11 Drawing Sheets

DISPLAY DEVICE DRIVEN WITH DUAL TRANSISTORS

BACKGROUND OF INVENTION

The invention relates to a display device having a plurality of pixels arranged in a matrix, and more particularly, to a display device having multiplex signal lines for transmitting a display signal to a plurality of pixels in one pixel array.

Recently, a liquid crystal display device has been used in a wide field ranging from medium-sized and large-sized displays for use in a computer, a television and the like to small-sized displays for use in a car navigation system and a cellular phone. Among the display devices, an active matrix liquid crystal display device using an active device such as a TFT (thin film transistor) or an MIM (metal insulator metal) receives attention because of its superior display characteristics. In general, the active matrix liquid crystal display device comprises a TFT array substrate having TFTs as active devices that are arranged in a matrix, an opposite substrate which is opposed to the TFT array substrate, and liquid crystal filled in-between the two substrates.

In a color liquid crystal display device, a color filter for performing color display is generally disposed on the opposite substrate. The liquid crystal display device comprises a display area composed of a plurality of pixels, each of which includes a pixel electrode and a TFT. The pixel electrode applies an electric field to liquid crystal, thereby changing light transmittance of the liquid crystal and thus displaying an image. Each of the pixels displays any one of RGB colors.

Each pixel applies an electric field to the liquid crystal in accordance with a display signal voltage inputted from a driver IC (integrated circuit). The driver IC is generally connected to the TFT through TAB (tape automated bonding), however, the driver IC may be disposed directly on a glass substrate of a TFT array. Generally, a plurality of source driver ICs for signal lines are provided on one side of the TFT array, and a plurality of gate driver ICs for gate lines for controlling gate voltages are provided on another side of the TFT array. A voltage inputted from each source driver IC is sent to each pixel electrode through source/drain electrodes of the TFT, and thus each pixel electrode applies an electric field to the liquid crystal. Changing the voltage allows a voltage being applied to the liquid crystal to change, thereby controlling the transmittance of the liquid crystal.

It is well known that the number of pixels is generally increased in order that the above-described liquid crystal display device displays a high-quality and high-definition image. It is also well known that the increase in the number of pixels causes the increase in the number of driver ICs for driving the liquid crystal display device and thus causes the increase in the cost of manufacturing the display device. Moreover, a serious problem arises that higher definition makes it more difficult to connect the driver ICs to the liquid crystal display device.

In order to facilitate terminal connection of a high-definition panel by reducing the number of signal input terminals, and also to reduce the cost of drivers, for example, an active matrix liquid crystal display using a thin film transistor (TFT), which comprises an active device serving as a switch between a signal input terminal of a TFT substrate and a signal line, is disclosed in Japanese Patent Application Laid-Open No. Hei 6 (1994)-138851.

The above-described display requires a transistor for use in a multiplex circuit, which a relatively large current can pass through. The reason is that the multiplex circuit is disposed outside a display area and one transistor is connected to each pixel array. Therefore, the display needs a transistor of a large size and thus has a problem that manufacturing yield is relatively low.

In Japanese Patent Application Laid-Open No. Hei 9 (1997)-329807, disclosed is a display device provided with a plurality of pixels arranged in a matrix in a display area, signal lines for selecting row positions, and pixel signal lines for providing each pixel information in a column direction, the display device selecting pixels in accordance with signals supplied by the signal lines and displaying the pixels in accordance with the pixel information provided to the selected pixels. A first device is provided for each pixel and operates in accordance with a signal from a signal line corresponding to each pixel. Block selecting means is provided for dividing pixels into blocks and selects the blocks into which the pixels are divided and collectively selecting the pixels included in the selected block. A second switching device is provided for each pixel and operating on the pixels corresponding to the block selected by the block selecting means. The second switching device acquires pixel information for each of the pixels with the first switching device and provides the acquired pixel information to display the pixels.

The above-described display device attempts to greatly reduce power consumption by eliminating the need to output a signal to each of the pixels that do not have to be rewritten, by selectively driving each pixel or each pixel block that is composed of a plurality of pixels. However, the display device cannot solve the above-mentioned problems to create a higher definition because the pixel signal line is provided for each pixel array.

A liquid crystal display device for multi-gradation at a low cost, which suppresses an increase in the number of components of a data line driver by making partially common use of the data line when performing multi-gradation display is constructed of a plurality of cells capable of controlling display pixels independently of one another, is disclosed in Japanese Patent Application Laid-Open No. Hei 5 (1993)-341734. The liquid crystal display device ensures that the increase in the number of components of the data line driver can be suppressed, however, the display device has a problem in that the number of gate lines is inevitably increased.

SUMMARY OF INVENTION

The invention is proposed in view of the foregoing problems. An object of the invention is to provide a display device capable of reducing the number of input terminals of signal lines. Another object of the invention is to provide a display device capable of reducing the number of output terminals of data drivers or reducing the number of data driver ICs. Still another object of the invention is to provide a high-definition display device ensuring that driver ICs can be connected to signal lines.

A display device according to one aspect of the invention comprises a plurality of scan lines for selecting pixel rows and a multiplex signal line for transmitting a display signal to a plurality of pixels in one pixel row, and further includes a select line. The select line selects at least one of the plurality of pixels to which the multiplex signal line transmits the display signal, in one pixel row selected by the scan lines.

A display device of a first aspect of the present invention is a display device including a display area having a plurality of pixels arranged in a matrix, which comprises: a plurality of scan lines (G) for selecting each of pixel rows; a multiplex signal line (D) for transmitting a display signal to at least two pixels in one pixel row selected by the scan lines; and a select line (E) provided independently of the plurality of scan lines. Here, the scan lines, the multiplex signal line and the select line are included in the display area, and the select line selects at least one of a plurality of pixels in the pixel row to which the multiplex signal line transmits the display signal.

A display device of a second aspect of the present invention is a display device including a plurality of pixels arranged in a matrix, comprising: a plurality of scan lines for selecting pixel rows; a multiplex signal line for transmitting a display signal to at least two pixels in one pixel row; and a select line provided independently of the plurality of scan lines. Here, one of the pixels in the pixel row to which the multiplex signal line transmits the display signal includes a pixel electrode, a first switching device and a second switching device. The second switching device is connected to the pixel electrode and the multiplex signal line. The first switching device is connected to the scan line and the select line. And the first switching device performs on-off control of the second switching device.

Various other objects, features, and attendant advantages of the present invention will become more fully appreciated as the same becomes better understood when considered in conjunction with the accompanying drawings, in which like reference characters designate the same or similar parts throughout the several views.

BRIEF DESCRIPTION OF DRAWINGS

For a more complete understanding of the present invention and the advantages thereof, reference is now made to the following description taken in conjunction with the accompanying drawings.

FIG. 2A shows a circuit diagram and FIG. 2B shows an operation timing chart.

FIG. 3A shows a circuit diagram and FIG. 3B shows an operation timing chart.

FIG. 6A shows a circuit diagram and FIG. 6B shows an operation timing chart.

FIG. 7A shows a circuit diagram and FIG. 7B shows an operation timing chart.

DETAILED DESCRIPTION

Figure 1:
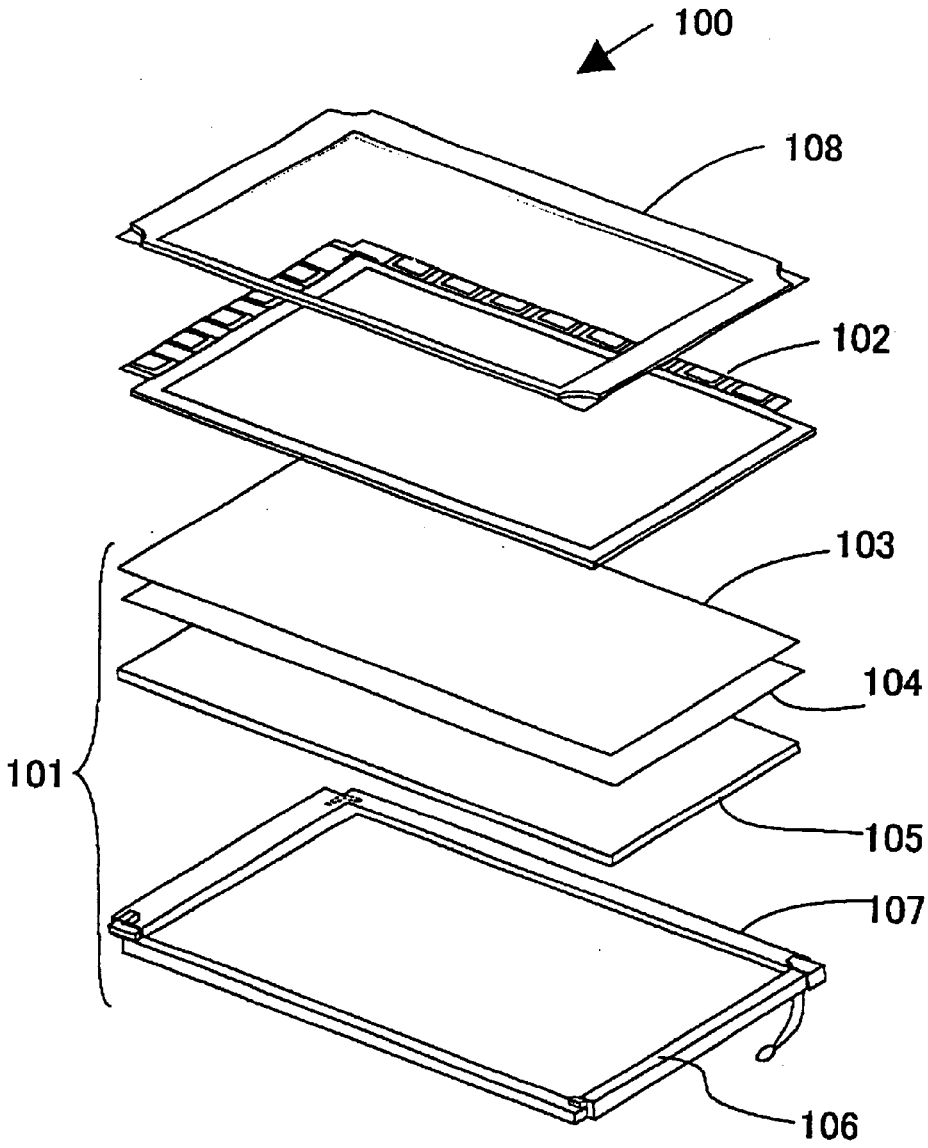
FIG. 1 is a perspective view of a general construction of a liquid crystal display device according to a first embodiment.

Incidentally, the corresponding elements of embodiments to be described later are put in parentheses in the following description in order to facilitate understanding of the invention. Needless to say, these elements are exemplary included in the present invention.

A pixel row is composed of a plurality of pixels selected by one scan line. Therefore, one pixel row is not necessarily composed of a linear arrangement of pixels. For example, in the case of two linear rows of pixels, each of two scan lines can select the pixels in each row by half. In this case, a plurality of pixels selected by each scan line constitute one pixel row. The pixel row and the pixel column can be either of the vertical or horizontal directions of the display device.

The display device of the present invention is a type of the display device, wherein the plurality of pixels in the pixel row to which the multiplex signal line transmits the display signal include a first pixel ($C_{e,\ n+1,\ m}$) that is selected by the select line and the scan line, and a second pixel ($C_{n+1,\ m}$) that is not selected by the select line but is selected by the scan line.

The display device of the present invention is a type of the display device, wherein the first pixel maintains the display signal inputted from the multiplex signal line when the select line selects the first pixel and the scan line selects the first pixel and the second pixel, and the second pixel maintains the display signal inputted from the multiplex signal line when the select line does not select the first pixel and the scan line selects the first pixel and the second pixel. Maintaining a display signal means that a pixel uses a display signal as a signal for displaying a desired image. For example, even if a pixel temporarily receives a different display signal, the signal is not practically used to display a desired image, and the pixel maintains only the received display signal with predetermined timing, thereby displaying the desired image.

The display device of the present invention is a type of the display device, wherein display signals are transmitted to every two pixels in each pixel row by different multiplex signal lines. Here, one of the two pixels receiving the display signal from the same multiplex signal line is selected by the select line and the scan line of the pixel row including the pixel, and the other pixel is selected only by the scan line.

The display device of the present invention is a type of the display device, wherein the select line is disposed substantially parallel to the plurality of scan lines.

The display device of the present invention is a type of the display device which further comprises a system of a first select line ($E_0$) and a system of a second select line ($E_1$) for transmitting select signals with different timing, wherein the first select line and the second select line select different pixels out of the pixels in the pixel row to which the multiplex signal line transmits the display signal.

The display device of the present invention is a type of the display device, wherein the pixels in the pixel row to which the multiplex signal line transmits the display signal include a first pixel ($C_{0,\ n,\ m}$) that is selected by the first select line ($E_0$), and a second pixel ($C_{1,\ n,\ m}$) that is selected by the second select line ($E_1$). Here, the first pixel maintains a display signal inputted when the first pixel is selected by the first select line and the scan line, and the second pixel maintains a display signal inputted when the second pixel is selected by the second select line and the scan line.

The display device of the present invention is a type of the display device, wherein display signals are transmitted to every two pixels in each pixel row by different multiplex signal lines. Here, one of the two pixels receiving a display signal from the same multiplex signal line is selected by the first select line and the scan line of the pixel row including the pixel, and the other pixel is selected by the second select line and the scan line.

The display device of the present invention is a type of the display device, wherein the select line and the multiplex signal line are disposed substantially parallel to each other and are alternately disposed between pixel electrodes, and either one of the select line or the multiplex signal line is disposed between the pixel electrodes.

The display device of the present invention is a type of the display device, which further comprising a third select line ($E_2$) for transmitting a select signal with different timing from the timings of the first and second select lines ($E_0$ and $E_1$), wherein display signals are transmitted to every three pixels in each pixel row by different multiplex signal lines. Here, one of three pixels receiving a display signal from the same multiplex signal line is selected by the first select line and the scan line of the pixel row including the pixel; another one of the pixels is selected by the second select line and the scan line; and the remaining pixel is selected by the third select line and the scan line.

The display device of the present invention is a type of the display device, wherein the multiplex signal line transmits a display signal to a first pixel and a second pixel in the same pixel row. Here, the first pixel includes the pixel electrode, the first switching device (701) and the second switching device (702). Here, the second switching device is connected to the pixel electrode and the multiplex signal line. The first switching device is connected to the scan line and the select line. The first switching device performs on-off control of the second switching device. The second pixel includes a pixel electrode and a third switching device (703). And the third switching device is connected to the pixel electrode of the second pixel, the multiplex signal line and the scan line.

The display device of the present invention is a type of the display device, wherein the multiplex signal line and the pixel electrode are connected to a source/drain electrode of the second switching device, and a source/drain electrode of the first switching device is connected to a gate electrode of the second switching device.

The display device of the present invention is a type of the display device, wherein the first pixel maintains a display signal transmitted from the multiplex signal line when the second switching device is in an on-state under the control of the first switching device, and the second pixel maintains a display signal transmitted from the multiplex signal line when the second switching device is in an off-state and the third switching device is in an on-state.

The display device of the present invention is a type of the display device, which further comprises a system of first select lines and a system of second select lines, wherein the first select lines and second select lines transmit select signals with different timing, and the multiplex signal line transmits a display signal to the first pixel and the second pixel in the same pixel row. The first pixel includes the pixel electrode, the first switching device (201) and the second switching device (202). The second switching device is connected to the pixel electrode of the first pixel and the multiplex signal line. The first switching device is connected to the scan line and the first select line. The first switching device performs on-off control of the second switching device. The second pixel includes the pixel electrode, a third switching device (203) and a fourth switching device (204). Here, the fourth switching device is connected to the pixel electrode of the second pixel and the multiplex signal line; the third switching device is connected to the scan line and the second select line; and the third switching device performs on-off control of the fourth switching device.

The display device of the present invention is a type of the display device, wherein a gate electrode of the second switching device is connected to the source/drain electrode of the first switching device; source/drain electrodes of the second switching device are respectively connected to the pixel electrode of the first pixel and the multiplex signal line; a gate electrode of the fourth switching device is connected to a source/drain electrode of the third switching device; and source/drain electrodes of the fourth switching device are respectively connected to the pixel electrode of the second pixel and the multiplex signal line.

The display device of the present invention is a type of the display device, wherein the select line and the multiplex signal line are disposed substantially parallel to each other and are alternately disposed between the pixel electrodes, and either one of the select line or the multiplex signal line is disposed between the pixel electrodes.

Embodiments of the invention will be described in detail below with reference to the accompanying drawings. In this embodiment, description will be made taking a liquid crystal display device as an example. Here, the liquid crystal display device includes a liquid crystal panel having liquid crystal filled in-between two opposed substrates, a liquid crystal module having a liquid crystal panel equipped with a driver circuit and a backlight unit, a liquid crystal display as an end product, and the like. A liquid crystal panel of the embodiment includes a display area composed of a plurality of pixels arranged in a matrix, and a frame area that is a peripheral area of the display area. Data lines composed of a plurality of signal lines, and gate lines which are scan lines are arranged in the display area. Besides these lines, enable lines that are select lines are also provided. Each signal line is a multiplex signal line and simultaneously transmits a display signal to two pixels in a pixel row. A pixel electrode of one of the two pixels, which is selected by both the gate line and the enable line, receives the display signal.

FIG. 1 is a perspective view for describing a general construction of a liquid crystal module of the embodiment. FIG. 1 shows a schematic representation of a construction of a liquid crystal module 100 having a sidelight type backlight unit. In FIG. 1, reference numeral 101 denotes a backlight unit, reference numeral 102 denotes a liquid crystal panel (a liquid crystal cell) equipped with a driver circuit, and reference numeral 103 denotes a diffusion sheet for diffusing light and thereby achieving even brightness on the liquid crystal display panel surface. Reference numeral 104 denotes a prism sheet for condensing light onto a front display surface of the liquid crystal display panel and thereby increasing luminance thereof, reference numeral 105 denotes a light guide plate for guiding and diffusing light from a light source, and reference numeral 106 denotes a frame for containing the components of the backlight unit 101, such as the light guide plate, the prism sheet, and the like.

The liquid crystal panel 102 comprises a display area composed of a plurality of pixels arranged in a matrix, and a frame area that is a peripheral area of the display area. The liquid crystal panel 102 also includes an array substrate (not shown) on which an array circuit is formed, an opposite substrate (not shown) being opposed to the array substrate, and liquid crystal filled in-between the two substrates. Reference numeral 107 denotes a cold cathode tube serving as a light source, and reference numeral 108 denotes a bezel for holding and protecting the liquid crystal cell 102 and the backlight unit 101 from the outside. The diffusion sheet 103, the prism sheet 104, the light guide plate 105, the frame 106 and the cold cathode tube 107 collectively constitute the backlight unit 101. The cold cathode tube 107 is disposed inside the frame 106 and is not shown directly.

Figure 2A:
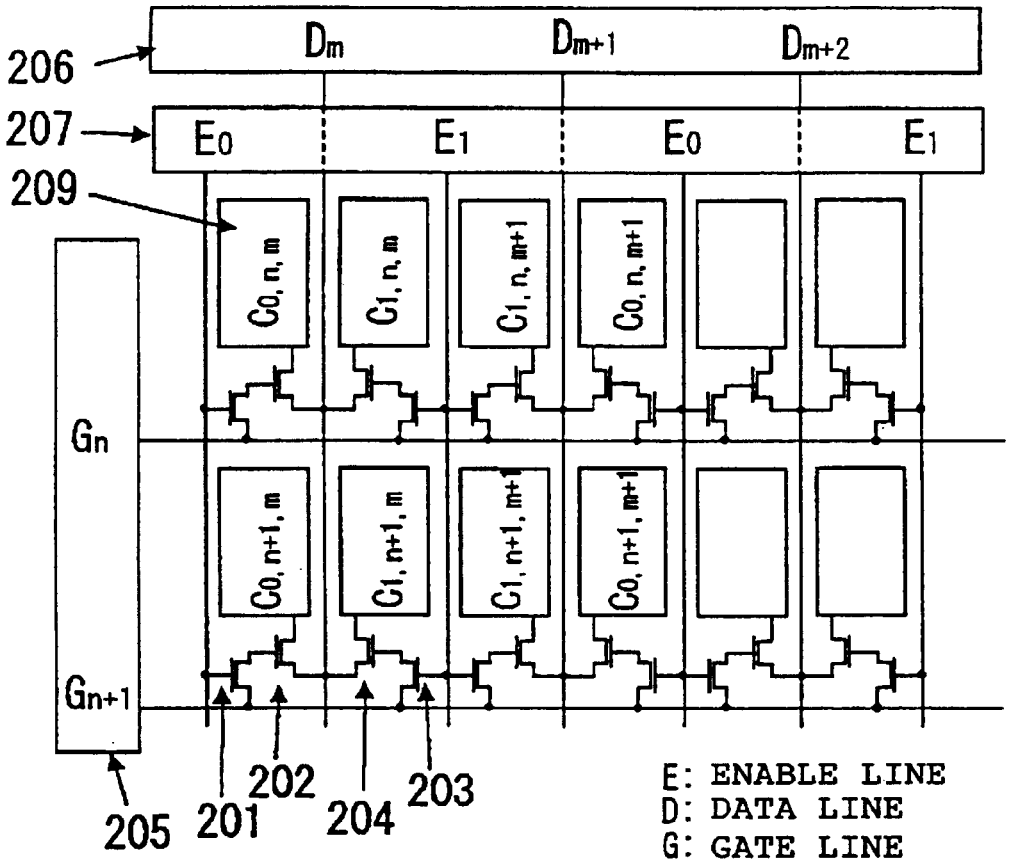
FIGS. 2A and 2B are a diagram and a chart for describing an array circuit of the liquid crystal display device according to the first embodiment.
Figure 2B:
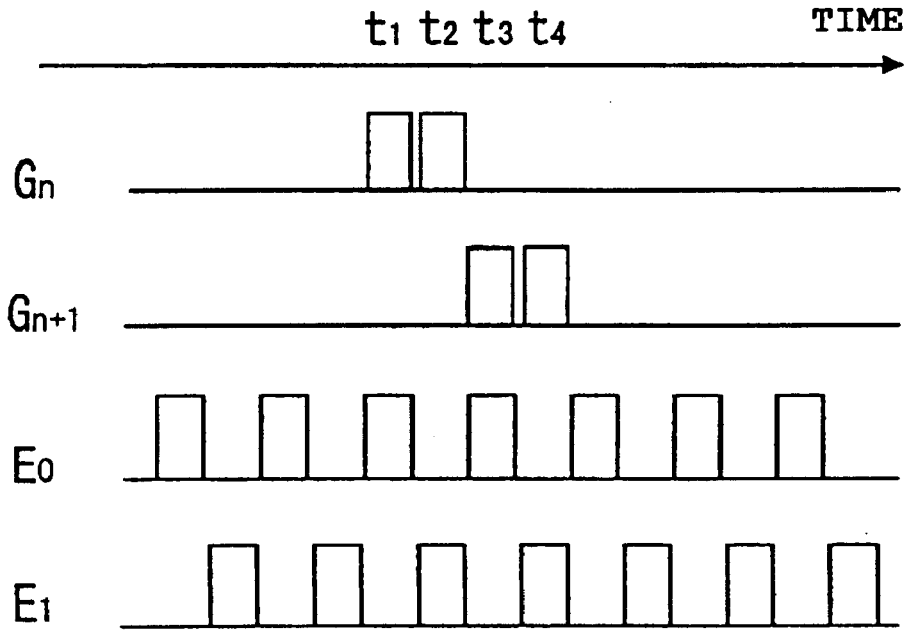

FIGS. 2A and 2B are schematic representations for describing the array circuit of the embodiment. FIG. 2A is a diagram of a general construction of a part of the circuit, and FIG. 2B is a chart for describing operation timing of the circuit. The description is made below with reference to FIGS. 2A and 2B. Note that FIGS. 2A and 2B are the representations for the purpose of describing the embodiment, and the representations of FIGS. 2A and 2B are different from those of an actual product in dimensions, shapes and the like.

In FIG. 2A, reference numerals 201, 202, 203 and 204 denote amorphous silicon TFTs (thin film transistors) serving as switching devices, reference numeral 209 denotes a pixel electrode for applying an electric field to the liquid crystal, reference numeral 205 denotes a gate driver, reference numeral 206 denotes a data driver, and reference numeral 207 denotes an enable line driver. A plurality of gate driver ICs and data driver ICs are arranged on the array substrate. These ICs collectively constitute a driver. FIG. 2A shows a part of each one of the gate driver ICs and the data driver ICs. The enable line driver 207 can be provided independently of the gate driver ICs and the data driver ICs or can be incorporated into the gate driver ICs and the like. The enable line driver 207 can be also formed directly on the array substrate.

The enable line comprises two systems of lines $E_0$ and $E_1$. Signals are transmitted independently over the two systems of lines. A display signal is transmitted from the data line to a pixel selected by the enable line and the gate line, and the pixel electrode 209 receives the display signal through the TFT 202 or 204. The enable lines ($E_0$ and $E_1$) extend parallel to the data lines ($D_m$; m=1, 2, . . . ). The data lines and the enable lines are disposed alternately to each other, and either the data line or the enable line is disposed between the pixel electrodes. Two pixels in one pixel row are connected to one data line. The transistors 201, 202, 203 and 204 connected to these lines are n-channel type TFTs. Moreover, at a high level of the enable line, supplied is a voltage equal to or higher than a voltage that is equal to a maximum voltage of the data line plus a voltage twice as high as a voltage equivalent to a voltage drop due to a threshold of the TFT. In addition, a voltage equal to or higher than a voltage that is equal to the maximum voltage of the data line plus the voltage equivalent to the voltage drop due to the threshold of the TFT is supplied to the gate line.

Each pixel includes the pixel electrode 209 and the two TFTs 201 (203) and 202 (204). The data line and the pixel electrode 209 are connected to source/drain electrodes of the TFT 202 (204), and one of source/drain electrodes of the TFT 201 (203) is connected to a gate electrode of the TFT 202 (204). A gate electrode of the TFT 201 (203) is connected to the enable line, and the counterpart of the source/drain electrodes of the TFT 201 (203) is connected to the gate line. Although not shown in FIG. 2A, a storage capacitor is formed between each pixel electrode $C_{n+1}$ (n denotes an integer) and each gate line $G_n$. An output from the source/drain electrode of the TFT 201 (203) performs on-off control of the TFT 202 (204), and the enable line performs on-off control on the TFT 201 (203). The gate line selects the pixel rows in sequence. In the embodiment, each pixel row is composed of a linear arrangement of pixels. Adjacent pixels in one pixel row have symmetrical pixel structures. Moreover, all pixels in one pixel column have the same pixel structure.

Now, an operation thereof will be described with reference to FIG. 2B. In the following description, an asterisk (*) following a comma after a subscript means that any applicable reference symbol or numeral can be included. For example, the phrase "pixel electrodes $C_{0,\ n,\ *}$" means the pixel electrodes of all the pixels connected to the enable line $E_0$, the gate line $G_n$ and any one of the data lines. FIG. 2B is a chart for describing a display operation of the pixel rows of the gate lines $G_n$ and $G_{n+1}$ Firstly, the display operation of the $G_n$ row will be described. At $t_1$, the gate line $G_n$ is at a high logical level, the other gate lines are at a low logical level, the enable line $E_0$ is at a high level, and the enable line $E_1$ is at a low level. In this state, all the data lines are transmitting display signals. In the pixel row $G_n$, the display signal is transmitted to pixel electrodes $C_{0,\ n,\ *}$. These correspond to half of the pixels in the pixel row $G_n$. Next, the gate line $G_n$ is rendered to a low logical level, and subsequently the enable line $E_0$ is rendered to a low logical level. After that, the display signal transmitted to the data line changes into a next display signal. The electrodes $C_{0,\ n,\ *}$ maintain the received display signal for about one frame period, thereby performing image display. Consecutive display signals may, of course, be of the same voltage. Note that a change in the display signal may take place before the enable line $E_0$ is rendered to a low logical level and after the gate line $G_n$ is rendered to a low logical level.

At $t_2$ in FIG. 2B, the gate line $G_n$ is at a high logical level, the other gate lines are at a low logical level, the enable line $E_0$ is at a low level, and the enable line $E_1$ is at a high level. In this state, all the data lines are transmitting next display signals. In the pixel row $G_n$, the display signal is transmitted to the pixel electrodes $C_{1,\ n,\ *}$. These correspond to the other half of the pixels in the pixel row $G_n$. The display signal at $t_2$ is inverted relative to a common potential, with respect to the display signal at $t_1$. Next, the gate line $G_n$ is rendered to a low logical level, and subsequently the enable line $E_1$ is rendered to a low logical level. The pixel electrodes $C_{1,\ n,\ *}$ maintain the display signal for about one frame period, thereby performing image display. Here, the display signal does not have to be inverted relative to the common potential.

Next, the display operation of the pixel row $G_{n+1}$ will be described. At $t_3$ in FIG. 2B, the gate line $G_{n+1}$ is at a high logical level, and the other gate lines are at a low logical level. The enable line $E_0$ is at a high level, and the enable line $E_1$ is at a low level. In this state, all the data lines are transmitting display signals. In the pixel row $G_{n+1}$, the display signal is transmitted to pixel electrodes $C_{0,\ n+1,\ m^*}$. These correspond to half of the pixels in the pixel row $G_{n+1}$. Next, the gate line $G_{n+1}$ is rendered to a low logical level, and subsequently the enable line $E_0$ is rendered to a low logical level. After that, the display signal to be transmitted to the data line changes. The pixel electrodes $C_{0,\ n+1,\ m}$ maintain the received display signal for about one frame period, thereby performing image display.

Subsequently, at $t_4$, the gate line $G_{n+1}$ is at a high logical level, the other gate lines are at a low logical level, the enable line $E_0$ is at a low level, and the enable line $E_1$ is at a high level. In this state, all the data lines are transmitting next display signals. In the pixel row $G_{n+1}$, the display signal is transmitted to pixel electrodes $C_{1,\ n+1,\ m}$. Next, the gate line $G_{n+1}$ is rendered to a low logical level, and subsequently the enable line $E_1$ is rendered to a low logical level. The pixel electrodes $C_{1,\ n+1,\ m}$ maintain the display signal for about one frame period, thereby performing image display. Thereafter, the pixel rows are selected in sequence.

As described above, according to the embodiment, multiplex time-division of a signal on the gate line and a signal on the enable line can be realized, and a desired potential can be supplied from one data line to a plurality of pixel arrays. Therefore, the number of outputs of data drivers can be reduced. In this case, what are additionally required are just an enable signal potential generator circuit and a data buffer (not shown) for supplying a potential for a pixel signal for a plurality of pixel arrays from one output of the data driver. Addition of these circuits causes no increase in the manufacturing cost, because a manufacturing process of the above circuit and buffer does not differ largely from a conventional manufacturing process. Moreover, transmission of a display signal from the data line to the pixel electrode through only one TFT allows reducing the size of the TFT, as compared to transmission of a display signal through two transistors. This leads to improvement in an aperture ratio.

Only part of the data lines, but not all of the data lines, may be constituted as multiplex data lines. The enable lines may be disposed substantially parallel to the gate lines. The polarity of a display signal relative to a common voltage may be changed in one pixel row or may be the same in all pixels in one pixel row.

The switching device is not limited to an amorphous silicon TFT, and a TFT using polysilicon or any other switching device may be used as the switching device so far as it can achieve the objects of the invention. Although the description is made with regard to an example in which an n-channel type TFT is used as a transistor, it can be easily understood that the same function can be realized by using a p-channel type TFT. Also in the embodiment, a display signal is transmitted from the data line to the pixel electrode through one TFT, however, a display signal may be transmitted to the pixel electrode through two TFTs. In this case, the gate line or the enable line is connected to each of the respective gate electrodes of the two TFTs, the data line is connected to a source/drain electrode of one of the TFTs, and the pixel electrode is connected to a source/drain electrode of the other TFT.

Display devices to which the embodiment can be applied include, besides the liquid crystal display device, a self-emission type display using an AM-PLED (active matrix polymer light emitting diode) or an AM-OLED (active matrix organic light emitting diode) which controls its light emission by operating a voltage to be applied to a polymeric organic film with an active device, and so on. The same is applicable to the following embodiments.

Figure 3A:
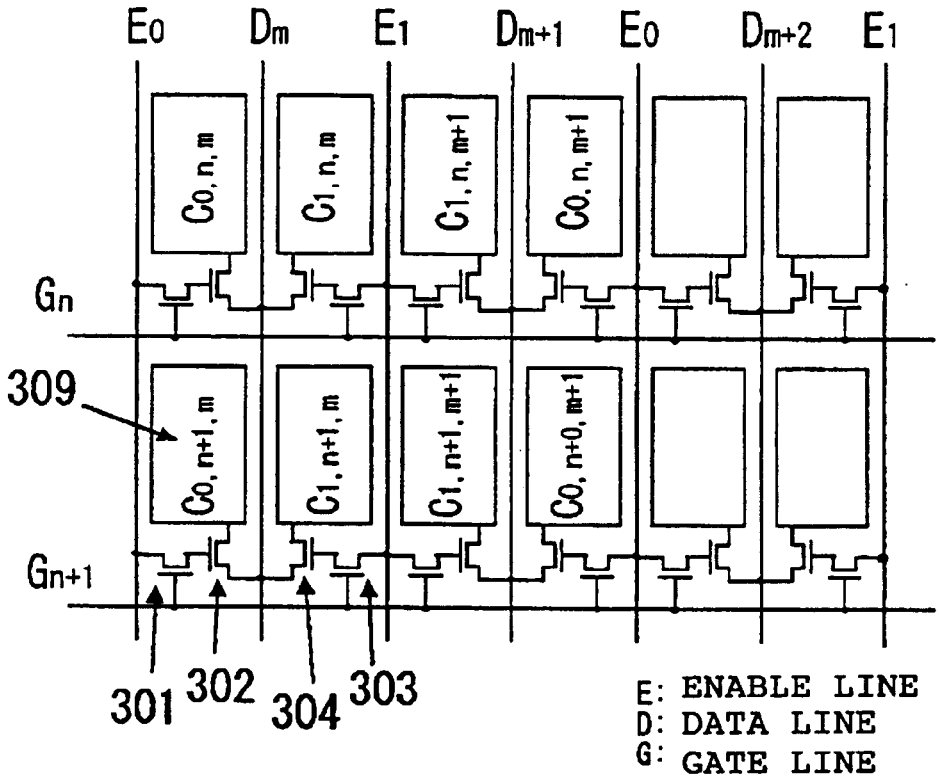
FIGS. 3A and 3B are a diagram and a chart for describing an array circuit of a liquid crystal display device according to a second embodiment.

Next, a display device of a second embodiment will be described. The general construction of the display device of the second embodiment is the same as that of the display device of the first embodiment, and thus the description thereof is omitted. The description is made with reference to a circuit diagram shown in FIG. 3A and an operation timing chart shown in FIG. 3B. Also in the case of FIG. 3A, the display device comprises a construction that the enable lines ($E_0$ and $E_1$) extend parallel to the data lines ($D_m$;m=1, 2, . . . ). The second embodiment is different from the first embodiment in the way of connecting TFTs. Each pixel has two TFTs 301 (303) and 302 (304). The pixel electrode and the data line are connected to source/drain electrodes of the TFT 302 (304). The enable line and a gate electrode of the TFT 302 (304) are connected to source/drain electrodes of the TFT 301 (303). The gate line is connected to a gate electrode of the TFT 301 (303). The other construction is equivalent or identical to the construction of the first embodiment, and thus the description thereof is omitted.

Figure 3B:
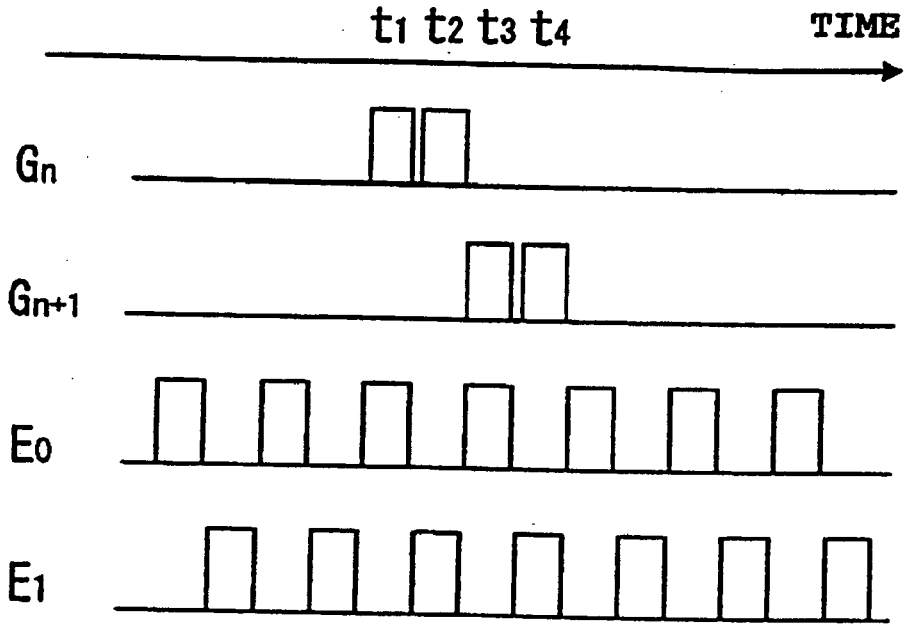

Now, an operation thereof will be described with reference to FIG. 3B. FIG. 3B is a chart for describing a display operation of the pixel rows of the gate lines $G_n$ and $G_{n+1}$. Firstly, the display operation of the $G_n$ row will be described. At $t_1$, the gate line $G_n$ is at a high logical level, and the other gate lines are at a low logical level. The enable line $E_0$ is at a high level, and the enable line $E_1$ is at a low level. In this state, all the data lines are transmitting display signals. In the pixel row $G_n$, the display signal is transmitted to the pixel electrodes $C_{0,n,m}$. These correspond to half of the pixels in the pixel row $G_n$. Next, the enable line $E_0$ is rendered to a low logical level, and subsequently the gate line $G_n$ is rendered to a low logical level. After that, the display signal transmitted to the data line changes into a next display signal. The electrodes $C_{0,n,m}$ maintain the received display signal for about one frame period, thereby performing image display. The logical level of the gate line $G_n$ may be kept high without being rendered to a low level. In this case, the logical level of the gate line $G_n$ remains high until $t_2$. Also, the display signal may change into a next display signal before the gate line $G_n$ is rendered to a low logical level but after the enable line $E_0$ is rendered to a low logical level.

At $t_2$ in FIG. 3B, the gate line $G_n$ is at a high logical level, the other gate lines are at a low logical level, the enable line $E_0$ is at a low level, and the enable line $E_1$ is at a high level. In this state, all the data lines are transmitting next display signals. In the pixel row $G_n$, the display signal is transmitted to the pixel electrodes $C_{1,n,m}$. These correspond to the other half of the pixels in the pixel row $G_n$. The display signal at $t_2$ is inverted relative to a common potential, with respect to the display signal at $t_1$. Next, the enable line $E_1$ is rendered to a low logical level, and subsequently the gate line $G_n$ is rendered to a low logical level. The pixel electrodes $C_{1,n,m}$ maintain the display signal for about one frame period, thereby performing image display. Here, the display signal does not have to be inverted relative to the common potential.

Next, the display operation of the pixel row $G_{n+1}$ will be described. At $t_3$ in FIG. 3B, the gate line $G_{n+1}$ is at a high logical level, and the other gate lines are at a low logical level. The enable line $E_0$ is at a high level, and the enable line $E_1$ is at a low level. In this state, all the data lines are transmitting display signals. In the pixel row $G_{n+1}$, the display signal is transmitted to the pixel electrodes $C_{0,n+1,m}$. These correspond to half of the pixels in the pixel row $G_{n+1}$. Next, the enable line $E_0$ is rendered to a low logical level, and subsequently the gate line $G_{n+1}$ is rendered to a low logical level. After that, the display signal to be transmitted to the data line changes. The pixel electrodes $C_{0,n+1,m}$ maintain the received display signal for about one frame period, thereby performing image display. The logical level of the gate line $G_{n+1}$ may be kept high without being rendered to a low level. In this case, the logical level of the gate line $G_{n+1}$ remains high until $t_4$.

Subsequently, at $t_4$, the gate line $G_{n+1}$ is at a high logical level, the other gate lines are at a low logical level, the enable line $E_0$ is at a low level, and the enable line $E_1$ is at a high level. In this state, all the data lines are transmitting next display signals. In the pixel row $G_{n+1}$, the display signal is transmitted to the pixel electrodes $C_{1,n+1,m}$. Next, the enable line $E_1$ is rendered to a low logical level, and subsequently the gate line $G_{n+1}$ is rendered to a low logical level. The pixel electrodes $C_{1,n+1,m}$ maintain the display signal for about one frame period, thereby performing image display. Thereafter, the pixel rows are selected in sequence.

Figure 4:
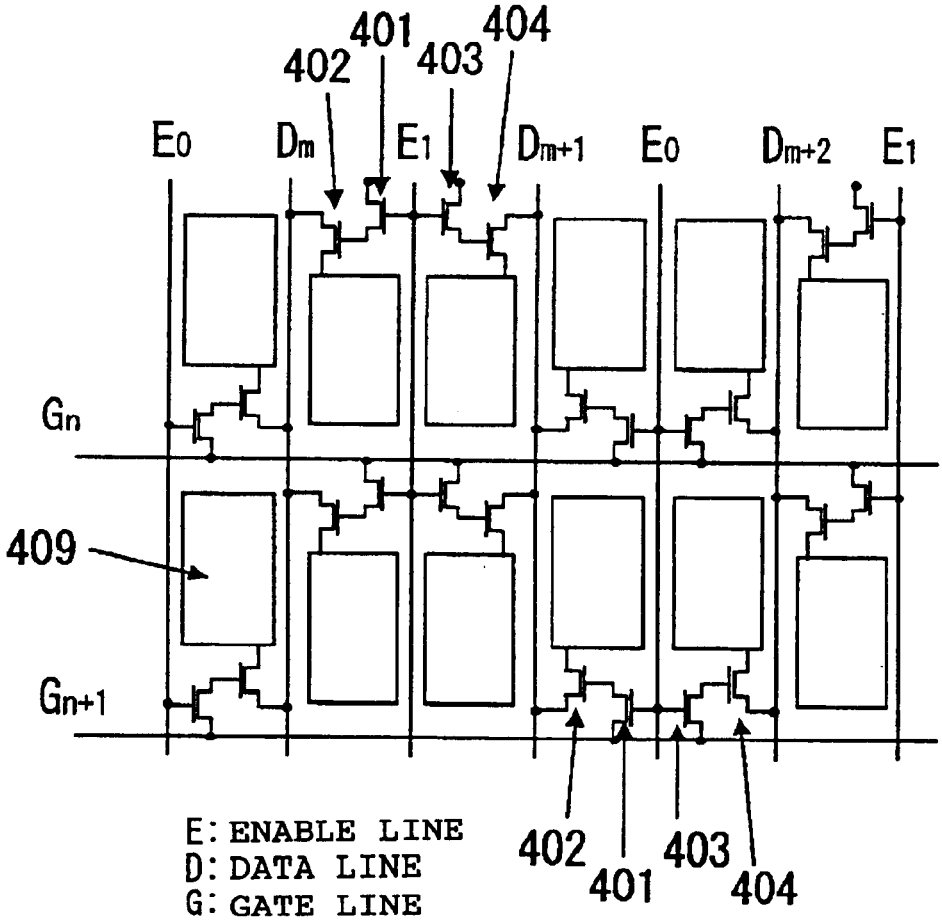
FIG. 4 is a circuit diagram for describing an array circuit of a liquid crystal display device according to a third embodiment.
Figure 5:
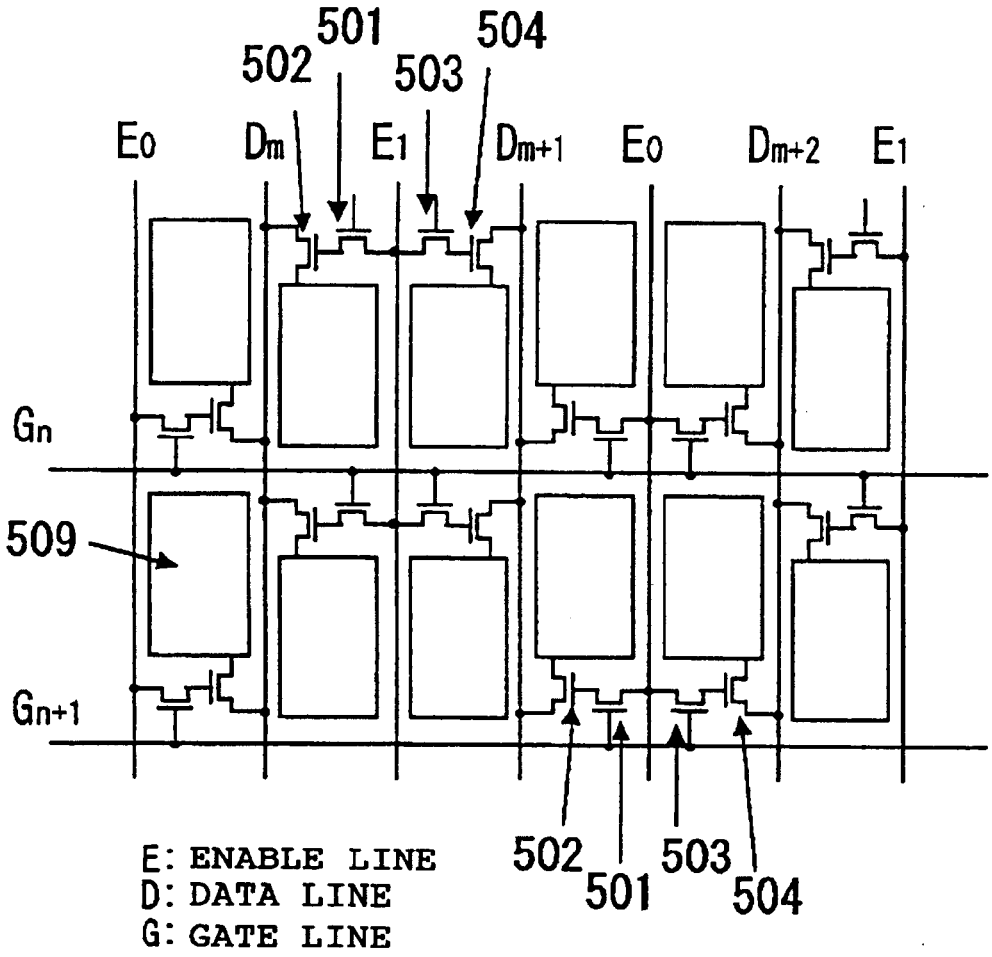
FIG. 5 is a circuit diagram for describing another array circuit of the liquid crystal display device according to the third embodiment.

Next, a third embodiment is shown in a circuit diagram of FIG. 4. The third embodiment has a modified arrangement of the pixels of the first embodiment, and specifically the third embodiment is different from the above-described embodiment in the points such as pixel electrodes $C_{1, n, m}$ are disposed adjacent to pixel electrodes $C_{0, n+1, m}$ on the right. In other words, each pixel row is not composed of a linear arrangement of pixels. In FIG. 4, each two pixels in one pixel row are linearly arranged. The other construction is equivalent or identical to the construction of the first embodiment, and thus the description thereof is omitted. The display operation of the third embodiment is also the same as that of the first embodiment, and thus the description thereof is omitted. Next, another embodiment is shown in a circuit diagram of FIG. 5. The embodiment shown in FIG. 5 has a modified arrangement of the pixels of the second embodiment, and specifically the embodiment shown in FIG. 5 is different from the above-described embodiment in the points such as pixel electrodes $C_{1, n, m}$ are disposed adjacent to pixel electrodes $C_{0, n+1, m}$ on the right. The construction shown in FIG. 5 is different from the construction shown in FIG. 4 in the way of connecting TFTs in the pixels. The other construction and the display operation of the embodiment shown in FIG. 5 are the same as those of the second embodiment, and thus the description thereof is omitted.

Figure 6A:
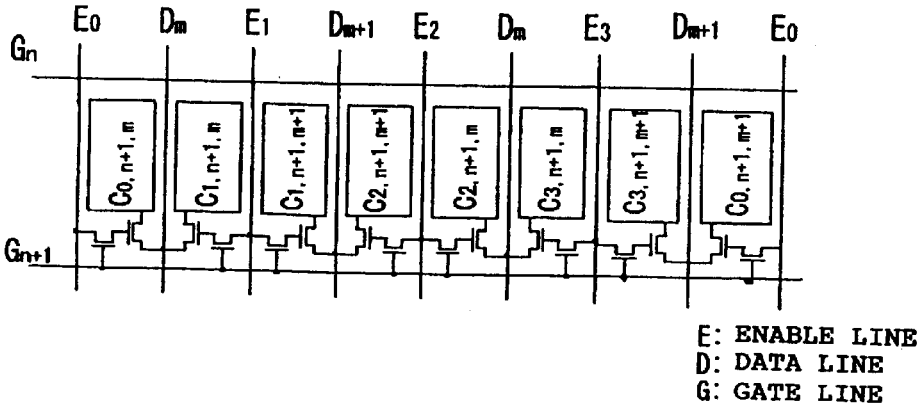
FIGS. 6A and 6B are a diagram and a chart for describing an array circuit of a liquid crystal display device according to a fourth embodiment.

In a fourth embodiment, the description is made with regard to an example of a display device comprising three or more systems of enable lines. In the embodiment, the display device comprises four systems of enable lines. One data line transmits a display signal to four pixels in one pixel row. Each enable line selects pixels equivalent to a quarter of pixels in one pixel row. A circuit construction will be described with reference to FIG. 6A. An array comprises four systems of enable lines $E_0$, $E_1$, $E_2$ and $E_3$. The enable line and the data line are disposed alternately with each other. Concerning the enable lines, each enable line is arranged in a sequential order. In FIG. 6A, the enable line $E_0$ has a function to select pixels $C_{0, *, *}$, and the enable lines $E_1$, $E_2$ and $E_3$ have functions to select pixels $C_{1, *, *}$, $C_{2, *, *}$ and $C_{3, *, *}$, respectively. The data line $D_m$ transmits a display signal to pixels $C_{*, *, m}$. The data line $D_{m+1}$ transmits a display signal to the right pixels $C_{*, *, m+1}$. The structure in each pixel and the connection between elements of the fourth embodiment are substantially the same as those of the second embodiment, and thus the description thereof is omitted.

Figure 6B:
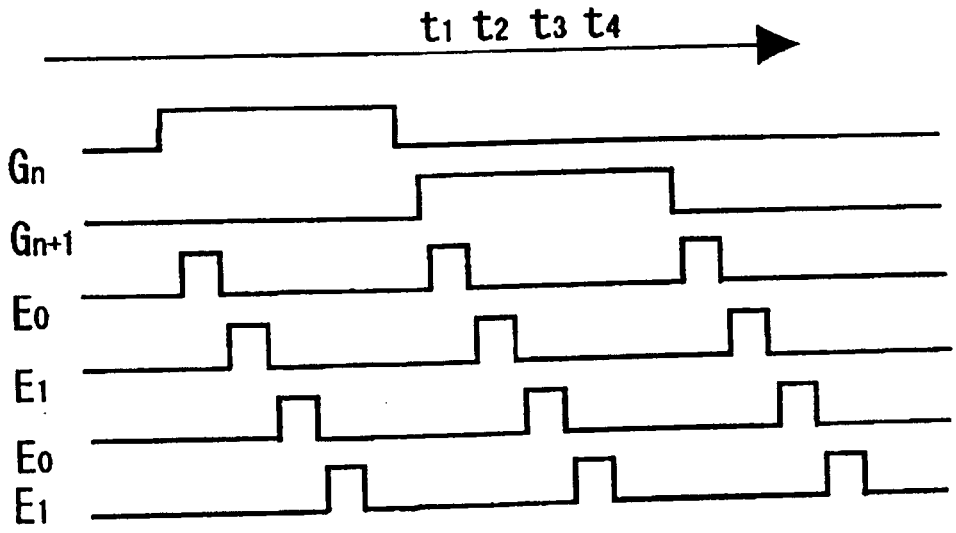

Now, an operation thereof will be described. The display operation of the pixel row $G_{n+1}$ will be described. At $t_1$ in FIG. 6B, the gate line $G_{n+1}$ is at a high logical level, and the other gate lines are at a low logical level. The enable line $E_0$ is at a high level, and the other enable lines are at a low level. In this state, all the data lines are transmitting display signals. In the pixel row $G_{n+1}$, the display signal is transmitted to pixel electrodes $C_{0, n+1, *}$. In FIG. 6A, the display signal is transmitted to pixel electrodes $C_{0, n+1, m}$ and pixel electrodes $C_{0, n+1, m+1}$. The pixel electrodes $C_{0, n+1, m}$ receive the display signal from the data line $D_m$, and the right pixel electrodes $C_{0, n+1, m+1}$ receive the display signal from the data line $D_{n+1}$. The selected pixels correspond to a quarter of the pixels in the pixel row $G_{n+1}$. Next, the enable line $E_0$ is rendered to a low logical level. The gate line $G_{n+1}$ is kept at a high logical level. After that, the display signal transmitted to the data line changes. The pixel electrodes $C_{0, n+1, *}$ maintain the received display signal for about one frame period, thereby performing image display. The logical level of the gate line may be once rendered to a low level, as in the case of the second embodiment. The same is applicable to the following description of an operation of the fourth embodiment.

Next, at $t_2$, the gate line $G_{n+1}$ is at a high logical level, and the other gate lines are at a low logical level. The enable line $E_1$ is at a high level, and the other enable lines are at a low level. In this state, all the data lines are transmitting next display signals independent of the previous display signals. In the pixel row $G_{n+1}$, the display signal is transmitted to pixel electrodes $C_{1, n+1, *}$. In FIG. 6A, the display signal is transmitted to pixel electrodes $C_{1, n+1, m}$ and pixel electrodes $C_{1, n+1, m+1}$. The pixel electrodes $C_{1, n+1, m}$ receive the display signal from the data line $D_m$, and the right pixel electrodes $C_{1, n+1, m+1}$ receive the display signal from the data line $D_{m+1}$. The selected pixels correspond to a quarter of the pixels in the pixel row $G_{n+1}$. Next, the enable line $E_1$ is rendered to a low logical level. The gate line $G_{n+1}$ is kept at a high logical level. After that, the display signal to be transmitted to the data line changes. The pixel electrodes $C_{1,n+1, *}$ maintain the received display signal for about one frame period, thereby performing image display.

Thereafter, similar operation is performed by the enable line $E_2$ at $t_3$ and the enable line $E_3$ at $t_4$. As described above, the fourth embodiment has three or more systems of enable lines, and therefore the embodiment can reduce the number of data lines or the number of input terminals, in addition to the effects achieved in the second embodiment.

Figure 7A:
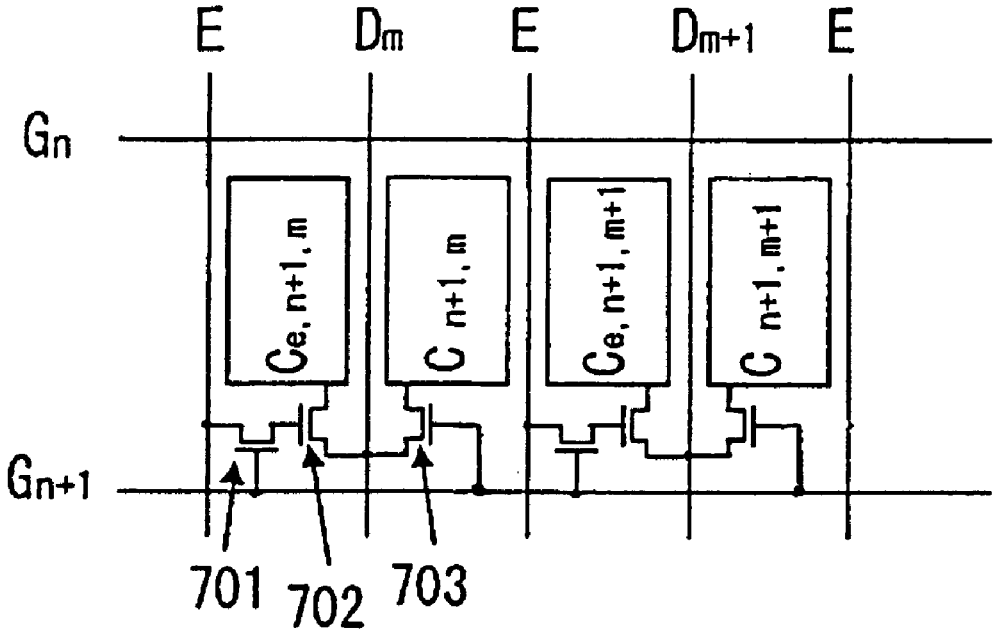
FIGS. 7A and 7B are a diagram and a chart for describing an array circuit of a liquid crystal display device according to a fifth embodiment.
Figure 7B:
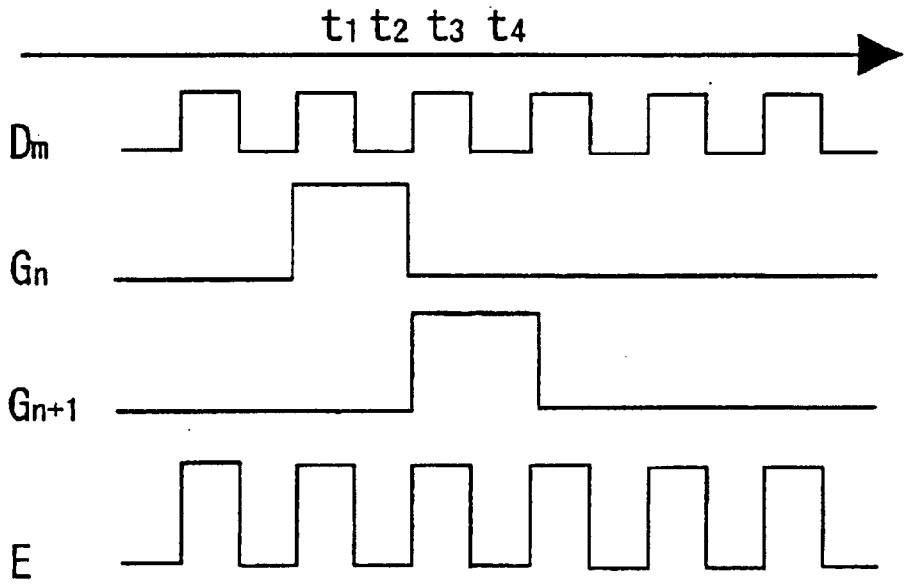

In a fifth embodiment, a display device having only one system of enable lines will be described. FIG. 7A shows a schematic representation of a circuit construction of the embodiment, and FIG. 7B is a timing chart for describing a display operation thereof. In FIG. 7A, each pixel row includes pixels having two different types of structures. One pixel $G_{e, n+1, *}$ has two TFTs 701 and 702. The construction of this pixel is the same as that of the pixel in the second embodiment, and thus the description thereof is omitted. The other pixel $G_{n+1, *}$ has only one TFT 703. The pixel electrode and the data line are connected to the source/drain electrode of the TFT 703, and the gate line is connected to the gate electrode thereof. In other words, this pixel is not connected to the enable line, hence the pixel is never selected by the enable line. These two types of pixels are alternately arranged in one pixel row. One data line transmits a display signal to two pixels which are the above-mentioned two types of pixels. The enable line $E_0$ is also disposed at a place where the enable line $E_1$ is disposed in the second embodiment. The other construction is substantially the same as the construction of the second embodiment, and thus the description thereof is omitted.

Now, an operation thereof will be described. FIG. 7B is a timing chart for describing the display operation of the pixel row $G_{n+1}$. The description is made below with reference to this chart. At $t_3$ in FIG. 7B, the gate line $G_{n+1}$ is at a high logical level, and the other gate lines are at a low logical level. An enable line E is at a high level. In this state, all the data lines are transmitting display signals. In the pixel row $G_{n+1}$, the display signals are transmitted to all the pixel electrodes.

Next, the enable line E is rendered to a low logical level. The gate line $G_{n+1}$ is kept at a high logical level. After that, next display signals are transmitted to the data lines. This is a state at $t_4$. In this state, the enable line E is at a low logical level, therefore pixel electrodes $C_{e, n+1, *}$ connected to the enable line are in an unselected state. The pixel electrodes correspond to pixel electrodes $C_{e, n+1, m}$ and $C_{e, n+1, m+1}$ in FIG. 7A. Therefore, the display signals are not transmitted to these pixel electrodes. On the other hand, pixel electrodes $C_{n+1, *}$ that are not connected to the enable line are not influenced by the selecting operation of the enable line. Therefore, these pixel electrodes are selected solely according to the logical level of the gate line. These pixel electrodes correspond to pixel electrodes $C_{n+1}$ and $C_{n+1, m+1}$ in FIG. 7A. Now, the gate line $G_{n+1}$ is at a high logical level, therefore the next display signals are transmitted to these pixel electrodes.

The pixel electrodes $C_{e,\ n+1,\ *}$ of the pixels connected to the enable line maintain the display signal received at $t_3$ for about one frame period, thereby performing image display. On the other hand, the pixel electrodes $C_{n+1,\ *}$ of the pixels that are not connected to the enable line maintain the display signal received at $t_4$ for about one frame period, thereby performing image display. Although a different signal from an original display signal is once transmitted to the pixel electrodes of the pixels that are not connected to the enable line, the pixel electrode holds this signal for only a short time, and therefore no problem exists in image display. Subsequently, the gate line $G_{n+1}$ is rendered to a low logical level.

The fifth embodiment has only one system of enable lines, and therefore the circuit construction can be made simpler. The enable lines may be disposed substantially parallel to the gate lines. The enable line may be connected to the gate electrode of the TFT 701, and the gate line may be connected to the source/drain electrode thereof.

Although the preferred embodiments of the present invention have been described in detail, it should be understood that various changes, substitutions and alternations can be made therein without departing from spirit and scope of the inventions as defined by the appended claims.

What is claimed is:

1. A display device including a plurality of pixels arranged in a matrix, comprising:

a plurality of scan lines for selecting pixel rows;

a multiplex signal line for transmitting a display signal to at least two pixels in one pixel row; and a select line provided independently of said plurality of scan lines, wherein one of the pixels in the pixel row to which said multiplex signal line transmits the display signal includes:

a pixel electrode;

a first switching device; and a second switching device, said second switching device is connected to said pixel electrode and said multiplex signal line, said first switching device is connected to said scan line and said select line, and said first switching device performs on-off control of said second switching device.

2. The display device according to claim 1, wherein display signals are transmitted to every two pixels in each of said pixel rows by different multiplex signal lines, one of the two pixels receiving the display signal from the same multiplex signal line is selected by said select line and the scan line of the pixel row including the pixel, and the other pixel is selected only by said scan line.

3. The display device according to claim 1, wherein said select line is disposed substantially parallel to said plurality of scan lines.

4. The display device according to claim 1, further comprising:

select lines provided independently of said plurality of scan lines, including:

a first select line; and a second select line, wherein said scan lines, said multiplex signal line and said select lines are disposed in said display area, and wherein said first select line and said second select line transmit select signals with different timing, said first select line and said second select line respectively select different pixels out of the pixels in the pixel row to which said multiplex signal line transmits the display signal.

5. The display device according to claim 1, wherein the pixels in the pixel row to which said multiplex signal line transmit the display signal include:

a first pixel that is selected by said first select line; and a second pixel that is selected by said second select line, said first pixel maintains a display signal inputted when said first pixel is selected by said first select line and said scan line, and said second pixel maintains a display signal inputted when said second pixel is selected by said second select line and said scan line.

6. The display device according to claim 5, wherein display signals are transmitted to every two pixels in each of said pixel rows by different multiplex signal lines, one of the two pixels receiving the display signal from the same multiplex signal line is selected by said first select line and the scan line of the pixel row including the pixel, and the other pixel is selected by said second select line and said scan line.

7. The display device according to claim 5, further comprising a third select line for transmitting a select signal with different timing from the timing of said first and second select lines, wherein display signals are transmitted to every three pixels in each of said pixel rows by different multiplex signal lines, one of the three pixels receiving a display signal from the same multiplex signal line is selected by said first select line and the scan line of the pixel row including the pixel, another one of said pixels is selected by said second select line and said scan line, and the remaining pixel of said pixels is selected by said third select line and said scan line.

8. The display device according to claim 1, wherein said select line and said multiplex signal line are disposed substantially parallel to each other and are alternately disposed between pixel electrodes, and only one of said select line or said multiplex signal line is disposed between the pixel electrodes.

9. The display device according to claim 1, wherein said multiplex signal line transmits a display signal to a first pixel and a second pixel in the same pixel row, said first pixel includes:

said pixel electrode;

said first switching device; and said second switching device, said second switching device is connected to said pixel electrode and said multiplex signal line, said first switching device is connected to said scan line and said select line, said first switching device performs on-off control of said second switching device, said second pixel includes:
a pixel electrode; and
a third switching device, and
said third switching device is connected to the pixel electrodes of said second pixel, said multiplex signal line and said scan line.

10. The display device according to claim 9, wherein said first pixel maintains a display signal transmitted from said multiplex signal line when said second switching device is rendered to an on-state under the control of said first switching device, and said second pixel maintains a display signal transmitted from said multiplex signal line when said second switching device is in an off-state and said third switching device is in an on-state.

11. The display device according to claim 1, wherein said multiplex signal line and said pixel electrode are connected to a source/drain electrode of said second switching device, and a source/drain electrode of said first switching device is connected to a gate electrode of said second switching device.

12. The display device according to claim 1, further comprising:

a first select line; and a second select line, wherein said first select line and said second select line transmit select signals with different timing, said multiplex signal line transmits a display signal to the first pixel and the second pixel in the same pixel row, said first pixel includes:
said pixel electrode,
said first switching device; and
said second switching device,
said second switching device is connected to the pixel electrode of said first pixel and said multiplex signal line,
said first switching device is connected to said scan line and said first select line,
said first switching device performs on-off control of said second switching device, said second pixel includes:
said pixel electrode;
a third switching device; and
a fourth switching device,
said fourth switching device is connected to the pixel electrode of said second pixel and said multiplex signal line,
said third switching device is connected to said scan line and said second select line, and
said third switching device performs on-on control of said fourth switching device.

13. The display device according to claim 12, wherein a gate electrode of said second switching device is connected to a source/drain electrode of said first switching device, a source/drain electrode of said second switching device is respectively connected to the pixel electrode of said first pixel and said multiplex signal line, a gate electrode of said fourth switching device is connected to a source/drain electrode of said third switching device, and a source/drain electrode of said fourth switching device is respectively connected to the pixel electrode of said second pixel and said multiplex signal line.

14. The display device according to claim 12, wherein said select lines and said multiplex signal lines are disposed substantially parallel to each other and are alternately disposed between the pixel electrodes, and only one of said select line or said multiplex signal line is disposed between the pixel electrodes.

* * * * *